United States Patent [19]

Cleary

[11] 3,932,051

[45] Jan. 13, 1976

[54] HIGHWAY CONSTRUCTION

[75] Inventor: Michael Cleary, Maidstone, England

[73] Assignee: Sumaspcae Limited, Croydon, England

[22] Filed: Sept. 3, 1974

[21] Appl. No.: 502,863

[52] U.S. Cl. ..... 404/82; 404/17
[51] Int. Cl.[2] ..... E01C 19/00
[58] Field of Search ..... 404/70, 74, 82, 134

[56] References Cited

UNITED STATES PATENTS 3,557,671 11/1974 Vasiloff ..... 404/82

3,819,291 6/1974 McConnaughy ..... 404/17

*Primary Examiner*—Mervin Stein
*Assistant Examiner*—Steven Hawkins
*Attorney, Agent, or Firm*—Norris & Bateman

[57] ABSTRACT

The load bearing capacities of carriageways or pavements of both flexible and rigid design are increased and failure thereof is, to a large degree, obviated by incorporating therein a sub-surface or surface layer of alkali-resistant glass fibre-reinforced cement.

12 Claims, 2 Drawing Figures

HIGHWAY CONSTRUCTION

Figure 1:
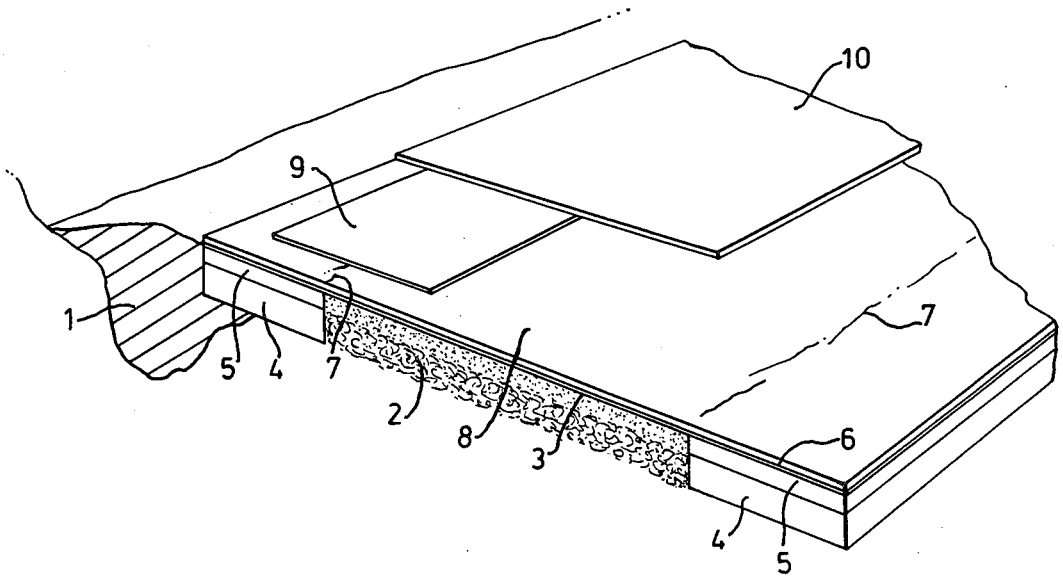

This invention relates to the construction, repair and strengthening of highway pavements and other load-bearing pavements, having either a flexible or a rigid design of construction.

Construction of highway pavements of rigid design is carried out in reinforced or mass concrete and construction of highway pavements of flexible design is carried out in granular materials with bituminous or other flexible binders, the thickness of construction and size and distribution of granules being dependent upon the load capacities of the materials and the necessity to prevent cohesive soils from approaching within 0.4m. or so of the surface in order to avoid frost action The life of a carriageway or pavement is dependent upon the inherent ability of the materials used to resist flexing action caused by repeated loadings, vibrations or reversals. Failure can occur at any level of the construction and in turn affects adjacent levels, finally appearing as cracks in the surface which causes the construction to become permeable to water and susceptible to frost, abrasive wheel action and other demands which open up the cracks and cause progressive deterioration.

Existing macadam roads, carefully constructed and drained by side ditches have had to be widened and rendered impervious in recent years to cater for higher traffic flows and longer vehicles and generally the width of such roads has been increased by about 1 to 2m. on either side. Differential movement occurs between the old and new parts of the road and causes minute cracks to appear at the surface with consequent deterioration and expensive maintenance operations.

It is the object of the present invention to increase the load-bearing capacities of and obviate to a large degree, failure in carriageways or pavements of both flexible and rigid design and this is achieved, according to the invention, by incorporating therein a sub-surface or surface layer of alkali-resistant glass fibre-reinforced cement.

The invention can be applied to the construction of new carriageways or to the repair or improvement of existing carriageways, thus reducing future maintenance requirements and can be employed quite economically by restricting it to the inside 2 to 3 meters of the carriageway where deterioration invariably occurs. The thickness of the said layer may vary from 10 to 20 mm. depending upon the loading for which the carriageway is designed, but a thickness of 10 mm. will be sufficient in most cases. Spalled and cracked concrete carriageways can be repaired and upgraded by employing the invention and interposing a non-adhesive mastic, aluminium foil or similar material having slip-surface characteristics between the said layer and the underlying structure at cracks and joints to allow strain in the layer to be spread, thus reducing the chance of reflective cracking appearing through the wearing course during thermal movement of the concrete. A wearing course comprising a 40–60 mm. thick layer of hot-rolled asphalt or resin bound material may be added on roads designed to carry a large volume of traffic.

The said layer is preferably produced by spraying said alkali-resistant glass fibre-reinforced cement or a mixture of said cement and a pozzolanic material onto the surface of a carriageway under repair or construction from vehicle-mounted angle-spray units operated in unison, but can be preformed and fixed with a bonding or adhesive agent at any level on or in a prepared surface or indentation. The said layer can itself form a temporary wearing surface.

Figure 2:
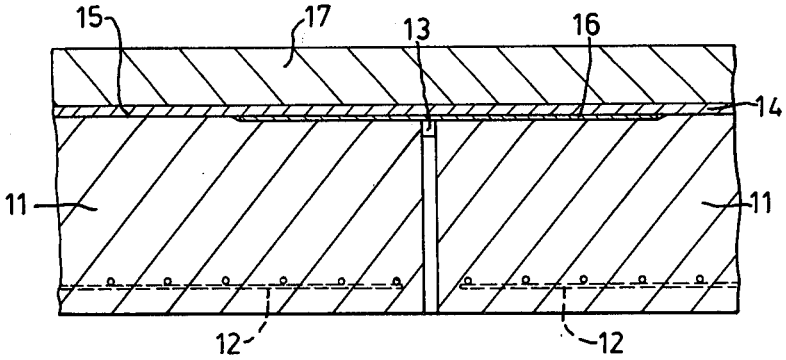

Two examples of the invention will be described with reference to the accompanying diagrammatic drawing in which:

FIG. 1 is a part-sectional perspective view of part of a widened highway pavement construction of flexible design under repair; and FIG. 2 is a longitudinal sectional view of part of a highway pavement construction of rigid design under repair.

Referring to FIG. 1, a drainage ditch 1, on one or both sides of a tar or water bound macadam road 2 of early design having a tar dressing 3, has been filled in and the road widened by adding to each side thereof, a strip, about 1 to 2m. in width, comprising a lower layer 4 consisting of lean concrete or a mixture of bitumen or tar bound macadam and an upper layer 5 consisting of bitumen or tar bound macadam of a high density, the whole being provided with a surface dressing 6 of tar or bitumen and 6 mm. chips. To improve the quality of the wearing surface and reduce the need for maintenance a layer of hot-rolled asphalt 8, generally 40–60 mm. thick has been added to the former surface dressing 6. In order to prevent or minimise the effect of any minute surface cracks 7 appearing along the junctions between the old and new parts of the road a layer or membrane according to the invention, which is shown at 9 in FIG. 1, generally measuring 10 mm. thick and 2 m. wide, is applied by spraying a mixture of alkali-resistant glass fibre-reinforced cement and a pozzolanic material onto the areas requiring attention. The whole may be subsequently covered by a 40–60 mm. thick layer 10 of hot-rolled asphalt or resin bound material to form the wearing surface of the road.

Referring to FIG. 2, a spalled and cracked concrete carriageway comprising longitudinally arranged sections 11 reinforced by steel mesh 12 and connected by filled joints 13 is repaired by the application of a 10 mm. thick layer 14 formed by spraying a mixture of zirconium glass fibre-reinforced cement and a pozzolanic material onto the old wearing surface 15 of the road and breaking the bond between the membrane 14 and surface 15 at each joint 13 by first interposing non-adhesive mastic-backed sheets 16 of 400 mm. wide aluminium foil or similar slip surface material to allow a spread of strain in the layer and reduce the chance of reflective cracking in the wearing course occurring during thermal movement of the concrete. As with the construction shown in FIG. 1, the layer 14 may be covered by a layer 17 of hot-rolled asphalt which is 40 to 60 mm. thick and forms a wearing course.

The function of the membrane is to distribute the stress caused by wheel loadings over a wider area of the highway construction and throughout its depth. The inherent tensile strength of the layer which is approximately 16 $MN/m^2$ at 28 days, prevents a large degree of strain and accommodates vibrations and reversals which govern the life of highway constructions. Further advantages of the layer are that it is relatively impervious and enables a surface to be laid over it within three hours. The present invention can be employed in road repairs over reinstated trenches, in the construction of new roads, particularly over poor load-bearing subgrades and for the upgrading of existing carriageways to enable them to carry heavier loads than those for which they were originally designed.

It will be understood that the dimensions of the said layer can be varied to suit different requirements. One example of a mix giving a layer having a tensile strength of 2300 lbf/sq.in. (16 $MN/m^2$) after 28 days is as follows:

| | | |
|---|---|---|
| Alkali-resistant glass fibre in approximately 50 mm. lengths to suit bond-length requirements in wide design | — | 5% |
| Ordinary Portland cement | — | 55% |
| Pulverised fuel ash or china clay waste | — | 40% |

I claim:

1. A method of constructing, repairing or strengthening a highway or other load-bearing pavement which includes the step of incorporating therein a layer comprising an alkali-resistant glass fibre-reinforced Portland cement.

2. A method according to claim 1, wherein said layer is formed by spraying onto the substructure of the pavement.

3. A method according to claim 1, wherein said layer is preformed and secured by a bonding agent at any level on or in a prepared surface or indentation.

4. A method according to claim 1, wherein said layer is subsequently covered by a wearing surface of hot-rolled asphalt or resin bound material.

5. A method according to claim 1, of repairing a highway pavement of flexible design which has been widened after construction, comprising applying said layer to the surface of said pavement at and in the region of the junction between the original pavement and those parts added during the widening thereof and subsequently covering the whole surface of the widened pavement with a wearing surface of hot-rolled asphalt or resin-bound material.

6. A method according to claim 1 of repairing a highway pavement of rigid design, wherein a non-adhesive mastic-backed sheet of aluminium foil or similar slip-surface material is interposed between said layer and the substructure of the pavement at and in the region of each lateral joint between sections of the longitudinally extending pavement.

7. A method according to claim 1, wherein said cement layer contains a pozzolanic material.

8. A method according to claim 1, wherein said layer is composed of 5% alkali-resistant glass fibre, 55% Portland cement and 40% pozzolanic material.

9. A method according to claim 8, wherein said alkali-resistant glass fibre is employed in 50mm. lengths.

10. A method according to claim 8, wherein said pozzolanic material is selected from pulverised fuel ash and china clay waste.

11. A highway or other load-bearing pavement incorporating a layer containing alkali-resistant glass fibre-reinforced Portland cement.

12. The pavement defined in claim 11 wherein said cement layer contains a distributed pozzolanic material.

* * * * *